US006587025B2

(12) United States Patent
Smith et al.

(10) Patent No.: US 6,587,025 B2
(45) Date of Patent: Jul. 1, 2003

(54) SIDE-BY-SIDE COIL INDUCTOR

(75) Inventors: Clark L. Smith, Norfolk, NE (US); Thomas L. Veik, Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 0 days.

(21) Appl. No.: 09/774,854

(22) Filed: Jan. 31, 2001

(65) Prior Publication Data

US 2002/0101318 A1 Aug. 1, 2002

(51) Int. Cl.[7] ..... H01F 5/00

(52) U.S. Cl. ..... 336/200; 336/83; 336/65; 336/232

(58) Field of Search ..... 336/65, 83, 180, 336/200, 232, 233, 234; 29/602.1

(56) References Cited

U.S. PATENT DOCUMENTS

| | | | | |
|---|---|---|---|---|
| 3,765,082 A | | 10/1973 | Zyetz | |
| 3,833,872 A | | 9/1974 | Marcus et al. | |
| 4,322,698 A | | 3/1982 | Takahashi et al. | |
| 4,641,118 A | | 2/1987 | Hirose et al. | |
| 4,689,594 A | | 8/1987 | Kawabata et al. | |
| 4,731,297 A | | 3/1988 | Takaya | |
| 5,302,932 A | | 4/1994 | Person et al. | |
| 5,479,695 A | * | 1/1996 | Grader et al. | 336/200 |
| 5,602,517 A | * | 2/1997 | Kaneko et al. | 336/185 |
| 5,880,662 A | | 3/1999 | Person et al. | |
| 5,970,604 A | | 10/1999 | Person et al. | |
| 5,986,533 A | | 11/1999 | Person et al. | |
| 6,097,273 A | * | 8/2000 | Frye et al. | 336/200 |
| 6,215,387 B1 | * | 4/2001 | Person et al. | 336/200 |
| 6,236,297 B1 | * | 5/2001 | Chou et al. | 336/200 |
| 6,249,205 B1 | * | 6/2001 | Meadors et al. | 336/200 |

FOREIGN PATENT DOCUMENTS

| | | |
|---|---|---|
| EP | 0310396 | * 4/1989 |
| JP | 5-347213 | * 12/1993 |

* cited by examiner

*Primary Examiner*—Tuyen T. Nguyen
(74) *Attorney, Agent, or Firm*—McKee, Voorhees & Sease, P.L.C

(57) ABSTRACT

A side-by-side coil inductor includes a first coil comprising a plurality of conductive first coil segments positioned one above another and connected in series. A second coil includes a plurality of conductive second coil segments positioned above one another and connected together in series. The first and second coil are in side-by-side position relative to one another and are connected together in series. Each of the first and second coil are approximately circular or square in configuration and the total configuration of the two coils is rectangular.

11 Claims, 5 Drawing Sheets

SIDE-BY-SIDE COIL INDUCTOR

BACKGROUND OF THE INVENTION

This invention relates to a side-by-side coil inductor.

Many electrical components, and electrical inductors in particular, have length and width dimensions which differ by a factor of 1.5 to 2.5 to facilitate component orientation. This is done to avoid mispositioning a square part by automated robotic assembly equipment which utilizes the size for proper orientation. In this process square components can be rotated 90° from the proper orientation. Proper orientation is important for yielding the proper electrical characteristics, and improper orientation can result in electrical defects.

Inductors are elongated conductors which can take many shapes: straight, wound in a shape such as an oval, square, round, or many other configurations. The maximum inductance from a length of wire requires it to be in the shape of a circle.

Many prior art inductors utilize an oval shaped coil pattern. FIGS. 1 and 2 illustrate these typical prior art inductors.

Referring to FIG. 1 the numeral 10 generally designates a typical prior art monolithic chip inductor. Inductor 10 comprises a plurality of sub assemblies stacked upon one another. A bottom sub assembly 20 includes a ferrite bottom layer 22 and a bottom coil inductor 24 printed over ferrite layer 22. Coil conductor 24 has an outer end 26 and an inner end 28. The bottom ferrite layer 22 includes a front edge 14, a rear edge 16 and opposite side edges 18.

Printed over the bottom subassembly 20 is a first intermediate subassembly 30. Subassembly 30 includes a first intermediate ferrite layer 32 having a via hole 34 extending therethrough. Via hole 34 is registered immediately above the inner coil end 28 of bottom conductor coil 24.

Printed over the upper surface of first intermediate ferrite layer 32 is a first intermediate coil conductor 36 having an outer end 40. Via hole 34 is filled with a conductive filler 42 which provides electrical connection between an inner end 38 of the first intermediate coil 36 and an inner end 28 of bottom coil 24.

Printed above the first intermediate subassembly 30 is a second intermediate subassembly 44 having a second ferrite layer 46 formed with a via hole 48 and having a second intermediate coil conductor 50 printed on the second intermediate ferrite layer 46. Second intermediate coil conductor 50 has an outer end 52 registered above via hole 48. Via hole 48 is filled with a conductive filler 56 registered above the outer coil end 40 of first intermediate coil 36. Conductive filler provides electrical connection between the outer coil end 40 of the first intermediate coil 36 and the outer coil end 52 of second intermediate coil 50. Second intermediate coil 50 also includes an inner end 54.

Printed above a second intermediate subassembly 44 is a top subassembly 58 which comprises a top ferrite layer 60 having a via hole 62 extending therethrough and a top coil conductor 64 printed over the upper surface thereof. Top coil conductor 64 includes a first end 66 and a second end 68. End 68 functions as a terminal and extends to the end edge of top ferrite layer 60. First terminal 66 is positioned above the via hole 62. Conductive filler 69 is within via hole 62 and provides electrical connection between the top terminal 66 and the inner coil end 54 of the second intermediate coil conductor 50.

A ferrite top cap layer 70 is printed over the top subassembly 58 and covers the top subassembly 58.

FIG. 2 illustrates schematically the typical prior art coil structure provided by the exploded view shown in FIG. 1. The coil commences at its lower end 26 and proceeds in a helical pattern upwardly until it reaches the upper end 68. The general configuration of the coil assembly 10 is rectangular or ovular. That is its length is substantially greater than its width. This enables a robotic assembly of the component into a circuit, and the robotic equipment can sense the rectangular shape of the assembly so as to permit it to be properly oriented within the circuitry.

However, the rectangular or ovular shape of the coils within the coil assembly detracts from the maximum inductance which can be obtained. Inductance is maximum with a circle or a square configuration.

The primary object of the present invention is the provision of an improved coil conductor.

A further object of the present invention is the provision of an improved coil inductor that utilizes the same rectangular space of prior coil inductors, but provides two circular or square coils within that space.

A further object of the present invention is the provision of an improved coil conductor which utilizes two circular or square coils in side-by-side relationship to maximize the inductance for parts of the same size.

A further object of the present invention is the provision of an improved side-by-side coil conductor which is economical to manufacture, durable in use, and efficient in operation.

SUMMARY OF THE INVENTION

A side-by-side coil inductor includes a first coil comprising a plurality of conductive first coil segments positioned one above another. The first coil segments are connected together in series. A second coil includes a plurality of conductive second coil segments positioned one above another. The second coil segments are also connected together in series. The first and second coils are in side-by-side position relative to one another and are connected together in series.

According to one feature of the invention a plurality of ferrite layers alternate between adjacent pairs of the first coil layers and between adjacent pairs of the second coil layers to create an inductor body having an elongated shape with a body length greater than the body width.

According to another feature of the invention the first and second coils have approximately the same width and length to maximize their inductance. Preferably they are square or circular in configuration, but they may have other similar configurations without detracting from the invention.

DETAILED DESCRIPTION OF THE PREFERRED EMBODIMENT

Figure 1:
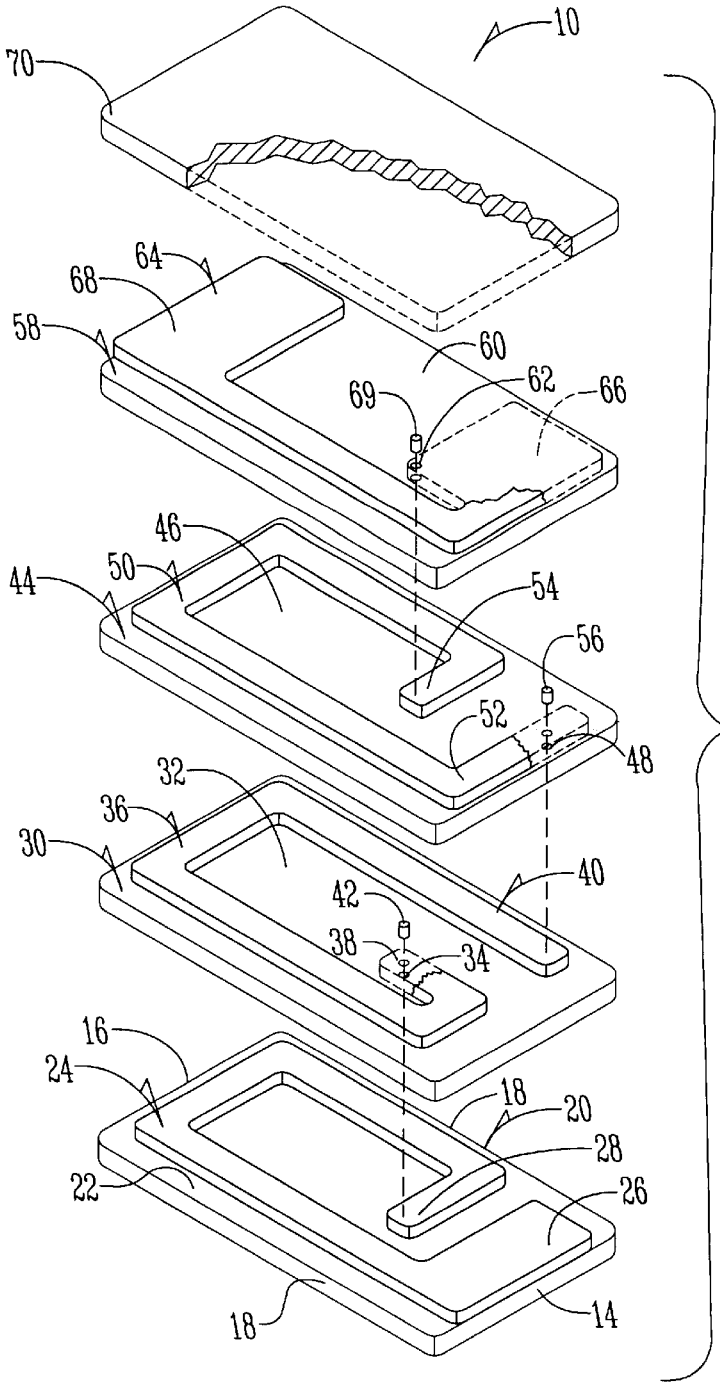
Fig. 1 (PRIOR ART)
FIG. 1 is an exploded perspective view of a prior art inductor coil.
Figure 2:
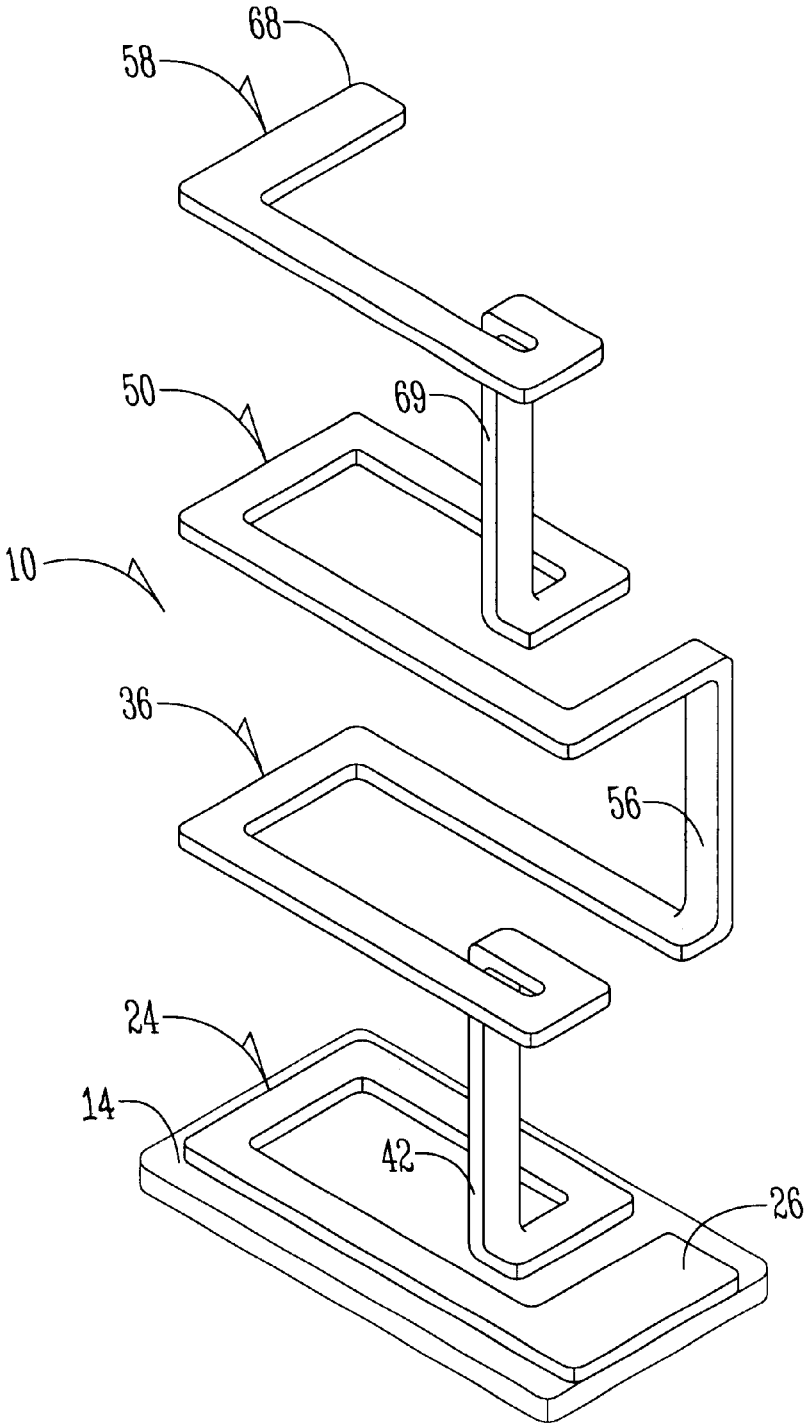
Fig.2 (PRIOR ART)
FIG. 2 is a schematic view of the prior art inductor coil of FIG. 1.
Figure 3:
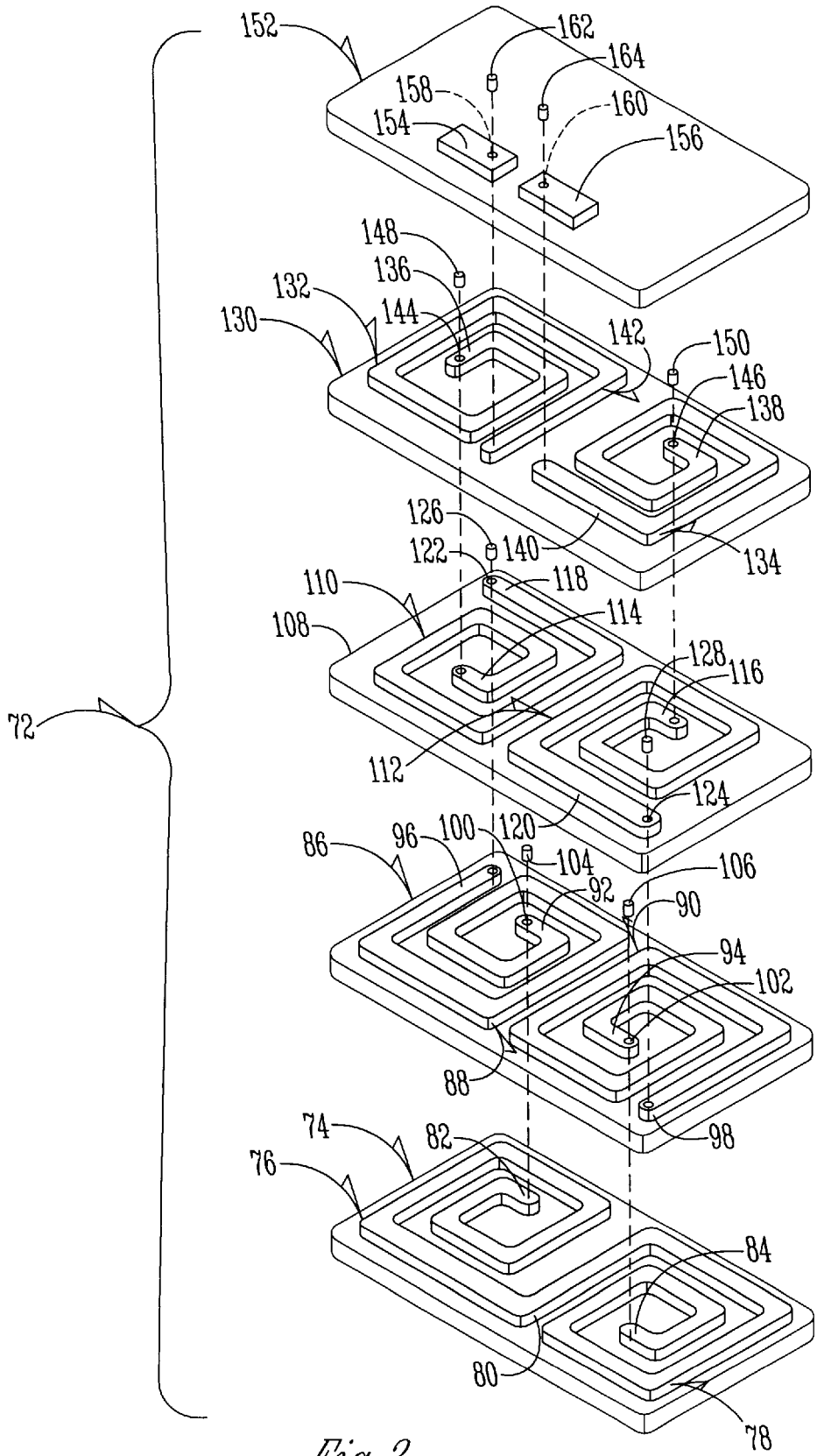
FIG. 3 is an exploded perspective view of the side-by-side coil inductor of the present invention.
Figure 4:
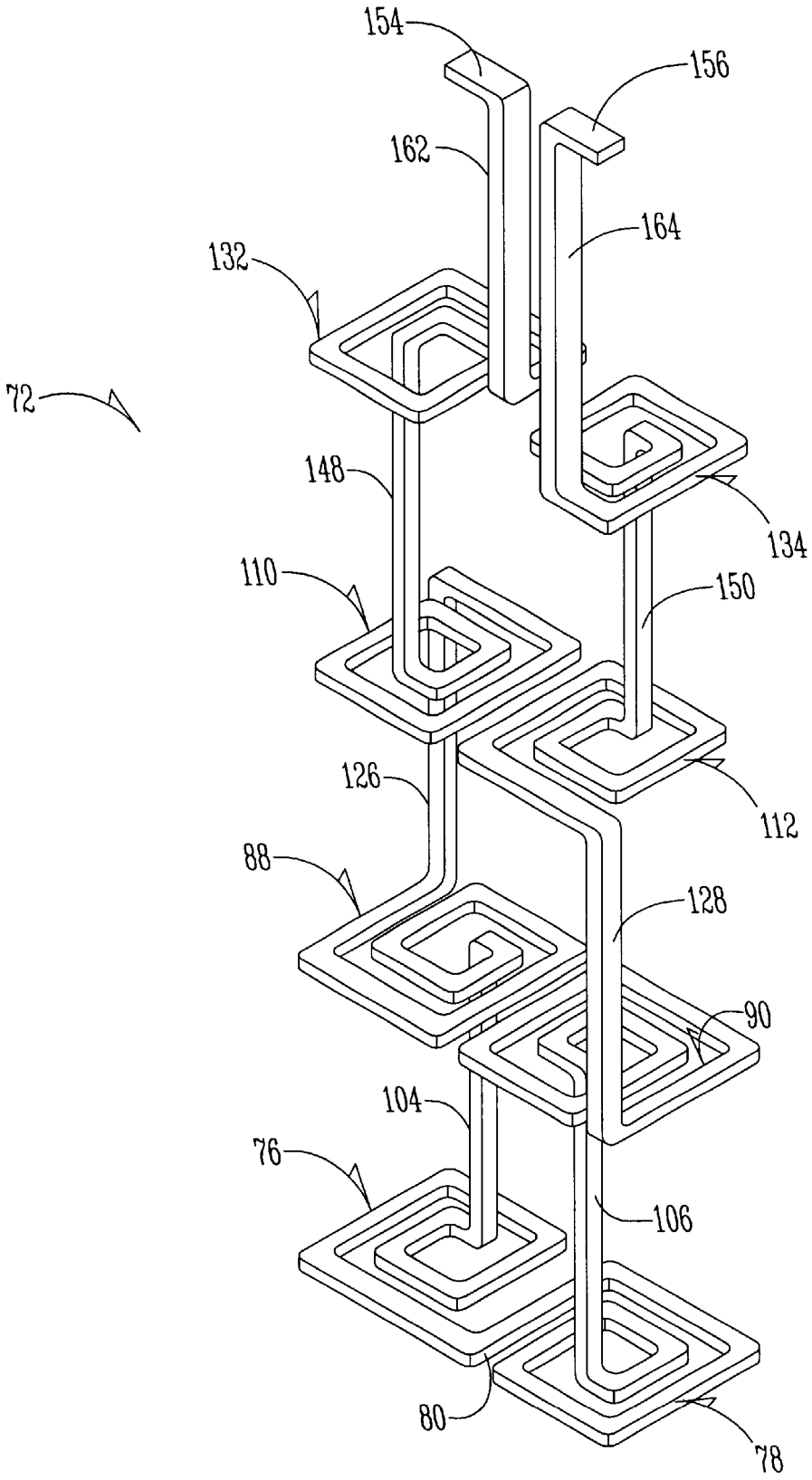
FIG. 4 is a schematic view of the side-by-side coil inductor of the present invention.

Referring to FIGS. 3 and 4 a side-by-side coil inductor 72 includes a bottom ferrite layer 74. First and second conductive bottom coil segments 76, 78 are fitted on the upper surface of the bottom ferrite layer 74. A coil connecting section 80 connects the two bottom segments 76, 78 in series with one another. Each of the bottom coil segments 76, 78 include an inner end 82, 84 respectively.

A second ferrite layer 86 is superimposed over the first ferrite layer 74 and includes first and second coil segments 88, 90 which are in registered alignment above the bottom coil segments 76, 78.

Each of the first and second coil segments 88, 90 includes an inner end 92, 94 respectively and an outer end 96, 98 respectively. Second ferrite layer 86 is provided with a first via hole 100 and a second via hole 102 registered below the inner ends 92, 94 respectively of the coil segments 88, 90. Within the via holes 100 and 102 are a first via fill 104 and a second via fill 106 respectively. Via fill 104 provides electrical connection between the inner end 92 of coil segment 88 and the inner end 82 of coil segment 76. Similarly the via fill 106 provides electrical connection between the inner end 94 of coil segment 90 and the inner end 84 of the coil segment 78.

A third ferrite layer 108 includes first and second coil segments 110, 112 mounted on the upper surface thereof. Coil segments 110, 112 include inner ends 114, 116 respectively and outer ends 118, 120 respectively. The third ferrite layer 108 also includes via holes 122, 124 which are registered below the outer ends 118 and 120 respectively of the coil segments 110, 112. Within the via holes 122, 124 are a first via fill 126 and a second via fill 128 which provide electrical connection between the outer ends 118, 120, of coil segments 110, 112 and the outer ends 96, 98 of coil segments 88, 90 respectively.

A fourth ferrite layer 130 includes first and second coil segments 132, 134 thereon. Each of the coil segments includes an inner end 136, 138 respectively and an outer end 142, 140 respectively. Registered below the inner end 136 is a first via opening 144 and registered beneath the inner end 138 is a second via opening 146. Via openings 144, 146 are filled with conductive via fills 148, 150 respectively. Via fills 148, 150 provide electrical connection between the inner end 136 of coil segment 132 and the inner end 114 of coil segment 110 and also provide communication between the inner end 138 of coil segment 134 and the inner end 116 of coil segment 112.

A cap ferrite layer 152 includes a first terminal 154 and a second terminal 156 imprinted thereon. A first cap via opening 158 is registered below first terminal 154 and a second cap via opening 160 is registered below second terminal 156. Via fills 162, 164 are mounted within the via holes 158, 160 and provide electrical communication between terminals 154, 156 and outer ends 142, 140 respectively of coil segments 132, 134. The number of layers of coil segments may be increased or decreased according to the inductance desired. Also, the terminals 154, 156 may be located on the top sides, or on combinations of surfaces of inductor body 72 without detracting from the invention.

FIG. 4 illustrates schematically the side-by-side coil configuration which is formed by the structure shown in FIG. 3. The coil commences at terminal 154 and progresses helically downwardly to coil segment 76. It then connects by means of connector segment 80 to the bottom coil segment 78 and progresses helically upwardly to the terminal 156. Preferably coil segments 132, 110, 88, 76 are all rectangular or circular in configuration and are not elongated or ovular or rectangular as in prior art devices. Similarly, the configurations 78, 90, 112, 134 are all circular or square in configuration and are not ovular, elongated or rectangular as in prior art devices. However, other configurations may be used for the coil segments including rectangular configurations. Using square or circular coil segments maximizes inductance.

Each of the coil segments is shown as progressing slightly further then 360° within the segment. However, the particular configuration may vary and the number of degrees in each coil segment can vary without detracting from the invention. The number of degrees in each coil segment can be greater than 360° or less than 360° as desired.

Figure 5:
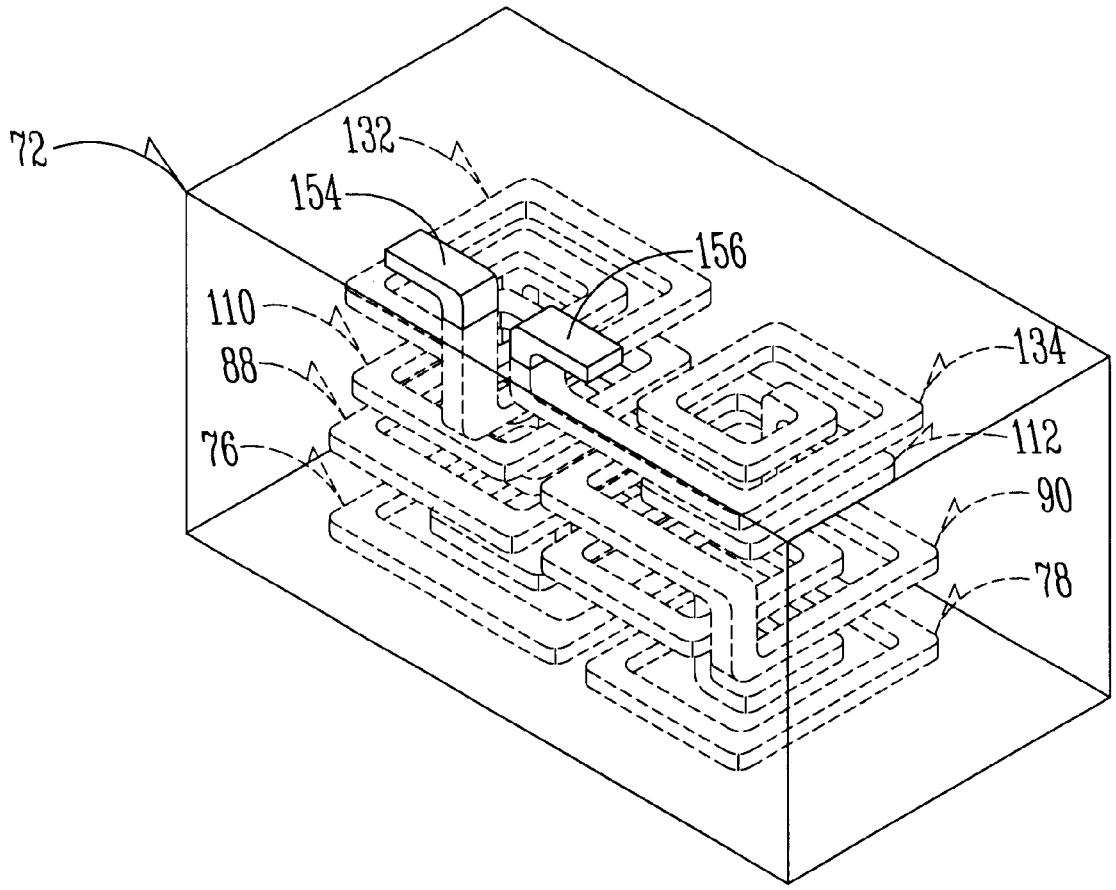
FIG. 5 is a perspective view of an inductor body showing the coil inductor within.

The assembled inductor 72 is shown in FIG. 5. If desired a dielectric coating may be used to cover the inductor 72, but leaving terminals 154, 156 exposed. Inductor 72 is rectangularly shaped. The rectangular shape makes possible the robotic assembly of the inductor assembly 72 into an electrical circuitry because the robotic equipment can sense the rectangular shape of the inductance assembly 72 and orient it properly. Thus a rectangular overall inductance assembly is achieved, while at the same time achieving the maximum inductance obtainable with a square or circular configuration within each coil segment.

The preferred implementation of the present invention may utilize a multilayer ceramic build-up technique such as thick film or low temperature cofired tape. The body is composed of a ferrite material while the conductive coil material is preferably silver or silver/palladium. The same results could be achieved by utilizing other thick film body materials and conductor materials as well as completely different techniques like traditional copper wire coil winding techniques used in molded bodies.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A side by side coil inductor comprising:

a first coil comprising a plurality of conductive first coil segments positioned one above the other, said first coil segments being connected together in series;

a second coil comprising a plurality of conductive second coil segments positioned one above the other, said second coil segments being connected together in series;

said first and second coil being in side by side position relative to one another and being connected together in series;

a top ferrite layer;

a bottom ferrite layer;

at least one middle ferrite layer between the top ferrite layer and the bottom ferrite layer; each of the at least one middle ferrite layer having a first via hole for connecting first coil segments in series and a second via hole for connecting second coil segments in series; and each of the at least one middle ferrite layers being separated from adjacent ferrite layers only by first coil segments and second coil segments.

2. A side by side coil inductor according to claim 1 wherein said first and second coils in combination have a combined length dimension and a combined width dimension, said combined length dimension being greater than said combined width dimension.

3. A side by side coil inductor according to claim 2 wherein a plurality of ferrite layers and said first and second coils form a body member, said body member having a body length dimension and a body width dimension, said body length dimension being greater than said body width dimension.

4. A side by side coil inductor according to claim 1 wherein said first coil and said second coil each have a coil width dimension and a coil length dimension which are equal.

5. The side-by-side coil inductor of claim 1 wherein the first and second coil segments being formed by a thick film process.

6. The side-by-side coil inductor of claim 1 wherein each of the coil segments progresses more than 360 degrees.

7. The side-by-side inductor of claim 1 wherein the first and second coil segments being formed by low temperature cofired tape.

8. A side by side coil inductor comprising:

a first helically shaped conductor coil having a plurality of first coil layers stacked above one another;

a second helically shaped conductor coil having a plurality of second coil layers stacked above one another;

each of said first and second conductor coils having horizontal length and width which are equal;

each of said first and second conductor coils being in side by side relation and being connected in series with one another;

a plurality of ferrite layers alternating between adjacent pairs of said first coil layers and between adjacent pairs of said second coil layers to create an inductor body having an elongated shape with a body length greater than a body width;

each of said first coil layers connected in series through at least one first coil layer via;

each of said second coil layers connected in series through at least one second coil layer via; and each of the plurality of ferrite layers being separated from at least one adjacent ferrite layer only by first coil segments and second coil segments.

9. The side-by-side coil inductor of claim 8 wherein the first and second coil segments being formed by a thick film process.

10. The side-by-side coil inductor of claim 8 wherein each of the coil segments progresses more than 360 degrees.

11. The side-by-side coil inductor of claim 8 wherein the first and second coil segments being formed by low temperature cofired tape.

* * * * *